US005355944A

United States Patent [19]

Potier

[11] Patent Number: 5,355,944

[45] Date of Patent: Oct. 18, 1994

[54] HEAT EXCHANGER COMPRISING A BUNDLE OF FINNED TUBES IMMOBILIZED WITH RESPECT TO A COLLECTOR HEADER ASSEMBLY

[75] Inventor: Michel Potier, Rambouillet, France

[73] Assignee: Valeo Thermique Moteur, Paris, France

[21] Appl. No.: 50,678

[22] Filed: Apr. 21, 1993

[30] Foreign Application Priority Data

Apr. 21, 1992 [FR] France ..... 92 04861

[51] Int. Cl.[5] ..... F28F 9/00

[52] U.S. Cl. ..... 165/149; 165/173

[58] Field of Search ..... 165/149, 173

[56] References Cited

U.S. PATENT DOCUMENTS

| | | | |
|---|---|---|---|
| 4,484,621 | 11/1984 | Kuchelmeister | 165/67 |
| 4,651,821 | 3/1987 | Moranne | 165/175 |
| 4,705,104 | 11/1987 | Potier | 165/149 |
| 4,738,308 | 4/1988 | Moranne | 165/149 |
| 5,190,101 | 3/1993 | Jalilevand et al. | 165/176 |

FOREIGN PATENT DOCUMENTS

| | | | |
|---|---|---|---|
| 2238858 | 3/1973 | Fed. Rep. of Germany | 165/149 |

*Primary Examiner*—Allen J. Flanigan
*Attorney, Agent, or Firm*—Richard K. Warther

[57] ABSTRACT

A heat exchanger, particularly for a motor vehicle, comprises a bundle of finned tubes, with each tube having an end portion which is sealingly mounted in a hole formed in a header plate on which a casing of a water header of the heat exchanger is secured. The heat exchanger has at least one locating or immobilising member interposed between the tube bundle and the water header. This locating member has a first portion which bears on the header and a second portion which extends parallel to the longitudinal direction of the tubes in the bundle, and which bears against the longitudinal edges of a group of several fins adjacent to the header plate. In this way any relative displacement of the tube bundle with respect to the header plate, in particular in a pivoting or torsional mode, is resisted.

9 Claims, 1 Drawing Sheet

HEAT EXCHANGER COMPRISING A BUNDLE OF FINNED TUBES IMMOBILIZED WITH RESPECT TO A COLLECTOR HEADER ASSEMBLY

FIELD OF THE INVENTION

This invention relates to heat exchangers, in particular for motor vehicles, of the kind comprising a bundle of finned tubes which are immobilised with respect to a water header of the same heat exchanger, the header comprising a header plate and a casing mounted on the header plate.

BACKGROUND OF THE INVENTION

From the specification of French published patent application No. FR2560368A, it is known to provide a heat exchanger of this type in which the ends of the tubes are sealingly fitted in holes formed in a header plate of a water header, a casing of which is secured over the collector, and in which immobilising or locating means are also provided for resisting any relative displacement of the tube bundles with respect to the header plate. Such displacement is liable to occur in particular in a pivoting or torsional mode.

In heat exchangers of the kind just mentioned, sealing between the end portions of the tubes and edges of the holes and the header plate is generally obtained by means of a gasket of rubber or similar material, which over lies the header plate and which is formed with collar portions, with each of these collar portions being engaged between an end portion of one tube and the edge of a corresponding hole in the header plate.

When such a heat exchanger is handled either before or during its fitting into a vehicle, or when it has been fitted in the vehicle, relative movements can occur, in particular in a pivoting or torsional load, of the tube bundle with respect to the header plate. These movements, which can occur in particular in those heat exchangers having only one row of aligned tubes, are detrimental to sealing between the end portions of the tubes and the edges of the holes in the header plate.

The immobilising or locating means which are provided in the arrangement described in the above mentioned French patent specification enable a rigid connection to be made between the tube bundle and the header plate, which is thus resistant to the relative displacements mentioned above. However, in that known arrangement, the immobilising means make it necessary to form slots along the longitudinal edges of the fins, or even to provide aligned openings which are formed through the latter, and this therefore calls for the use of special fins.

In addition, the immobilising means in the document mentioned above comprise lugs which are moulded integrally with the header casing or header plate, or even with fingers which are moulded integrally with the latter. This makes it necessary to manufacture specific components by moulding in plastics material.

DISCUSSION OF THE INVENTION

A principal object of the invention is to overcome the drawbacks mentioned above.

A particular object of the invention is to provide a heat exchanger of the general type mentioned above, but which uses standard fins.

A further object of the invention is to provide such a heat exchanger in which it is unnecessary, or virtually unnecessary, to make any modifications to the water header.

Yet another object of the invention is to provide such a heat exchanger which can be manufactured easily and inexpensively.

To this end, according to the invention, in a heat exchanger of the kind mentioned above, the immobilising or locating means comprise at least one applied element interposed between the tube bundle and the water header, the said applied member having a first portion which is adapted to engage on the header, and a second portion extending parallel to the longitudinal direction of the tubes in the tube bundle and bearing against the longitudinal edges of a group of several fins situated adjacent to the header plate.

Due to the fact that the heat exchanger employs at least one said applied element for locating and immobilising the tube bundle with respect to the header plate, it is not necessary to provide specially designed fins; nor is it necessary to modify the structure of the water header. Therefore, standard fins can be used.

In addition, during fitting of the heat exchanger it is merely necessary to interpose at least one locating element between the tube bundle and the said assembly.

In a first embodiment of the invention, the heat exchanger has at least one pair of locating elements in opposed relationship to each other, each of which comprises a first portion in the form of a lug secured on the header casing, and a second portion, again in the form of a lug which extends parallel to the longitudinal direction of the tubes in the bundle. It is then merely necessary to arrange the elements of any given pair on either side of the tube bundle and in engagement with the opposed longitudinal sides of the latter.

Preferably, the first and second portions of each said element extend in planes which are substantially parallel to each other, and these two portions are joined together by a flat intermediate portion of the element.

The first portion of each said element is preferably secured on a boss of the water header, for example by means of a screw or other similar fastening means.

In a second embodiment of the invention, the locating or immobilising means comprise a plate element which is adapted to be interposed flat between the header plate and the group of fins, this plate element having at least one aperture through which tubes of the bundle extend, the plate element also having at least two lugs which are joined at right angles to the plate element and which are adapted to bear respectively on two longitudinal opposed sides of the tube bundle. During assembly of the heat exchanger, it is merely necessary to interpose this plate element between the tube bundle and the header plate in order to ensure that the tube bundle is thereafter immobilised with respect to the water header.

In a first modification of this arrangement, the plate element is arranged to bear on the underside of a peripheral projecting flange of the header plate. In another modification, the plate element is arranged to bear on the underside of a central portion of the header plate which is surrounded by a peripheral projecting flange of the latter.

The plate element and the lugs depending from it are preferably formed as a single component, either as a sheet metal pressing or by moulding in an appropriate plastics material.

In the description of preferred embodiments of the invention which follows and which is given by way of example only, reference is made to the accompanying drawings.

DESCRIPTION OF PREFERRED EMBODIMENTS OF THE INVENTION

Figure 1:
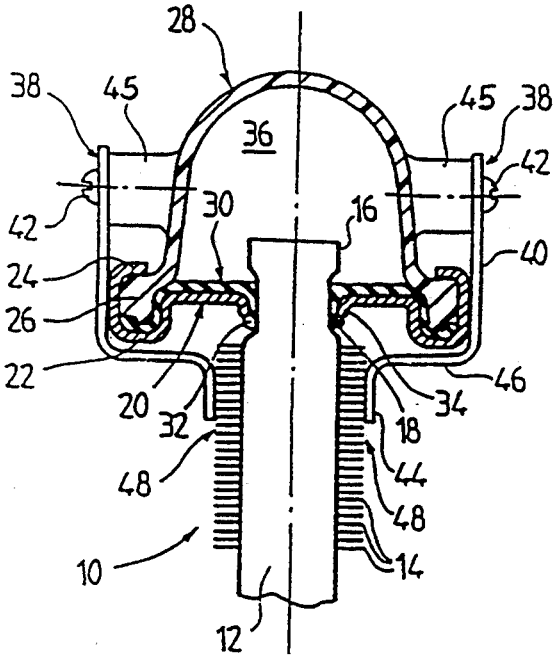
FIG. 1 is a view in transverse cross section showing part of a heat exchanger in a first embodiment of the invention.

The heat exchanger of which part is shown in FIG. 1, comprises a water header consisting of a header casing 28 having an open side closed by a header plate 20 on which the casing 28 is mounted, together with a bundle of tubes 10. The latter consists of a single row of aligned tubes, which are provided with flat fins 14 parallel to each other and extending at right angles to the longitudinal direction of the tubes 12. In this example the tubes 12 have a body with an oblong cross section, and circular cylindrical end portions 16. These end portions 16 are sealingly mounted in holes 18 formed in the header plate 20, which will be referred to as a collector in the rest of this description, for brevity. The collector 20 has a projecting peripheral flange 22 which terminates in bent-over securing lugs 24. The lugs 24 are turned over the peripheral flange 26 of the header casing 28. In this example the header casing 28 is made by moulding in a suitable plastics material. Sealing at the level of the end portions 16 of the tubes 12 is provided by a gasket 30 of an elastomeric or similar material, which overlies one surface of the collector 20. The gasket 30 includes collar portions 32 which are gripped between the end portions 16 of the tubes and the edges 34 of the holes in the collector 20. The header casing 28 and collector 20 together define an internal space 36 of the header.

To the extend to which it has just been described, the collector is of conventional construction. At the other end of the tubes 12, there may typically be another water header, constructed similarly to that which has just been described. Due to the fact that the heat exchanger only has one row of tubes 12, it can happen that the water header becomes displaced, either by pivoting action or in torsion. This can cause fracture to occur in the region of the collar portion 32 of the gasket 30, resulting in a danger of leakage of the fluid flowing in the heat exchanger.

This danger is circumvented by locating means which, in this example, comprise at least one pair of opposed elements 38 which are arranged on either side of the collector 20. Each of the locating elements 38 comprises a first portion 40 in the form of a straight lug, which is adapted to be secured on the header casing 28 by means of a screw 42 which passes through the lug 40 and is engaged in a boss 45 moulded integrally with the header casing. The first portion 40 of the locating element 38 extends in a direction which is substantially parallel to the tubes 12, and it is joined to a second portion 44 of the element 38. This second portion 44 extends parallel to the direction of the tubes 12 in the bundle, and is arranged to bear against the longitudinal edges of a group of several of the fins 14 adjacent to the collector 20. The portions 40 and 44 are joined together through a flat portion 46 of the element 38, which may be arranged to engage the underside of the flange 22 of the collector 20.

The header casing 28 has two opposed bosses 45 arranged as a pair, on which two of the elements 38 are secured respectively. The respective second portions 44 of the elements 38 are engaged against two opposed longitudinal sides 48 of the tube bundle.

In this first embodiment, a standard collector 20 and standard fins 14 can be used. All that is needed is simply to provide a header casing having a particular form of construction which includes at least one pair of bosses 45.

Figure 2:
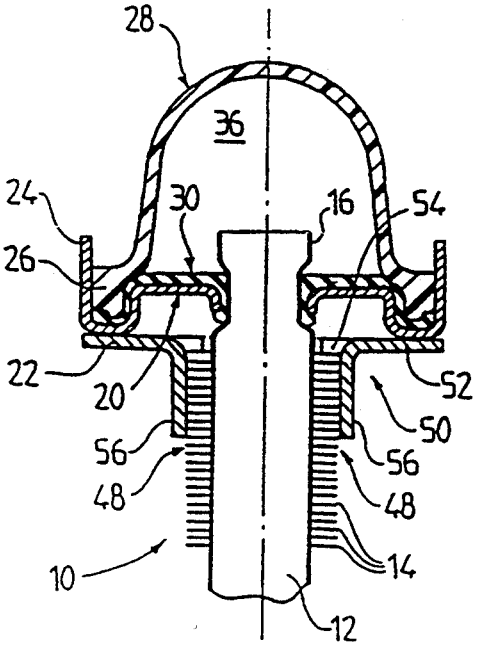
FIG. 2 is a view in transverse cross section showing part of a heat exchanger in a second embodiment of the invention.

In the second embodiment shown in FIG. 2, to which reference is now made, the heat exchanger not only has a standard type of header plate (collector) and standard fins, but also a standard type of header casing. In this embodiment, the immobilization of the assembly of collector 20 and header casing 28 with respect to the tube bundle 10 is obtained by means of at least one locating member 50. The member 50 comprises a plate element 52 of generally rectangular shape, which is such as to be interposed flat between the flange 22 of the collector 20 and the group of fins 14, that is to say the fin which is closest to the collector 20. The plate element 52 has at least one aperture 54 which may, for example, be generally rectangular in shape, to allow at least one of the tubes 12 to pass through it.

The locating member 50 has at least two opposed lugs 56, which are joined at right angles to the plate element 52, and which bear respectively on the two opposed longitudinal sides 48 of the tube bundle. The lugs 56 thus perform the same function as the second portions 45 (also in the form of lugs) of the locating members 38 in the heat exchanger shown in FIG. 1. Also in this example, the locating member 50 is in the form of a single component of pressed sheet metal, for example aluminum sheet. The locating member 50 is simply interposed during assembly between the tube bundle and the collector 20.

Figure 3:
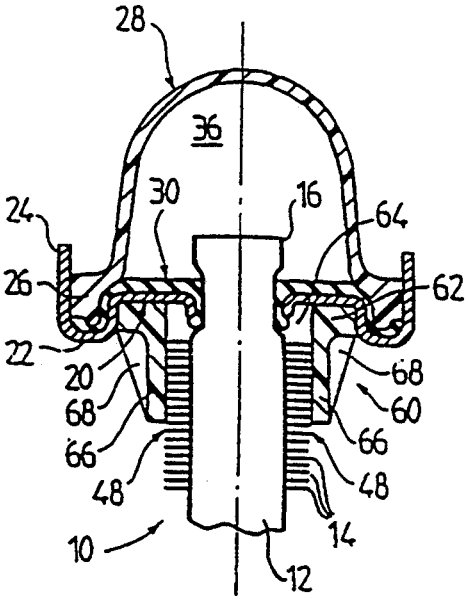
FIG. 3 is a view in transverse cross section, taken on the line III—III in FIG. 4, showing part of a heat exchanger in a third embodiment of the invention, which is a modified form of the heat exchanger shown in FIG. 2.
Figure 4:
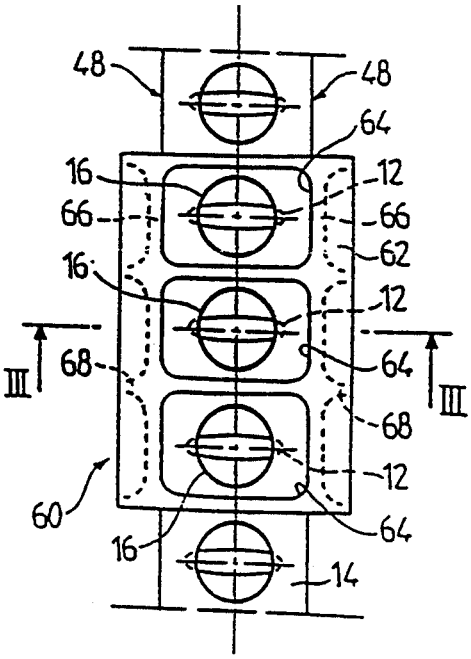
FIG. 4 is a view in elevation showing part of the locating plate in the heat exchanger seen in FIG. 3, applied on the fins of the tube bundle.

Reference is now made to FIGS. 3 and 4, which show a modified form of the heat exchanger having at least one applied element or locating member 60 which is closely related to the locating member 50 of FIG. 2. The locating member 60 comprises a generally rectangular plate element 62, or locating plate, which bears on the underside of the header plate (collector) 20, and more particularly in the central region of the latter which lies radially inward of, and which is delimited by, the peripheral flange 22.

The locating plate 62 has in this example three rectangular apertures 64, each of which accommodates one of the tubes 12 of the bundle.

The locating member 60 also has two lugs 66 which are joined at right angles to the plate 62, and which bear respectively on the two longitudinal sides 48 of the tube bundle. The lugs 66 thus perform the same function as the lugs 56 in the embodiment of FIG. 2. Also in this example, the locating member 60, comprising the plate 62 and its two lugs 66, is formed as a single component by moulding in a suitable plastics material. As in the case shown in FIG. 2, the locating member 60 is interposed during fitting between the endmost fin of the tube bundle and the collector 20.

In this way, the invention enables the heat exchanger to be made in a particularly simple manner, such that the tube bundle is completely immobilised and located with respect to the water header. Thus any relative movements that might occur, in particular in the case of heat exchangers having only one row of tubes, is avoided.

The invention is most particularly applicable, though without limitation, to heat exchangers to motor vehicles, and in particular to engine cooling radiators or cabin heating radiators.

What is claimed is:

1. A heat exchanger comprising: a bundle of tubes, each having a terminal end portion; fins surrounding the tubes; a fluid header comprising a header casing having an open side and a header plate closing the open side, the header plate having defining holes formed through it, with the end portions of the tubes being sealingly fitted in the holes; said header plate extending outward beyond the width of the tube and surrounding fins so that the lower portion of the header plate and the fins form a recess, and locating means associated with the bundle of tubes and the header plate for resisting relative displacement between the bundle of tubes and the header plate, wherein the locating means comprises at least one applied element interposed between the tube bundle and the header, with said applied element comprising a substantially right angled support member having a first substantially horizontal portion for engaging on the lower portion of the header and a second substantially vertical portion extending parallel to the longitudinal direction of the tubes and engaging against opposed longitudinal edges of a group of several said fins adjacent to the header plate so as to immobilize the tube bundle and header plate as one unit.

2. A heat exchanger according to claim 1, having at least one pair of said applied elements in opposed relationship to each other, with each said element of a pair comprising a first portion in the form of a lug secured to the header casing and a second portion in the form of a lug extending parallel to the longitudinal direction of the tubes.

3. A heat exchanger according to claim 2, wherein the said first and second portions extend in respective planes substantially parallel to each other, each said element further comprising a flat portion joining its said first and second portions together.

4. A heat exchanger according to claim 2, wherein the header casing is formed with a plurality of bosses, with the said first portion of each said element being secured to a respective one of the said bosses.

5. The heat exchanger according to claim 1, wherein the locating means comprise at least one applied element comprising a plate element interposed flat between the header plate and the fins, the said plate element defining at least one aperture with said tubes extending through the latter, the plate element further including at least two opposed lugs joined to the remainder of the plate element at right angles thereto and engaged respectively against the two longitudinal sides of the tube bundle.

6. A heat exchanger according to claim 5, wherein the header plate has a peripheral flange having an underside, the plate element of the or each said applied element bearing against the underside of the said flange.

7. A heat exchanger according to claim 5, wherein the header plate has a peripheral flange defining within it a central portion of the header plate, the plate element of the or each said applied element being applied against the said central portion.

8. A heat exchanger according to claim 5, wherein the plate element of the or each said applied element and the said lugs depending from it are integral with each other and are in the form of a sheet metal pressing.

9. A heat exchanger according to claim 5, wherein the plate element of each said applied element and the said lugs which depend from it are formed integrally by moulding in a plastics material.

* * * * *